United States Patent [19]

Doutrich et al.

[11] Patent Number: 4,616,415

[45] Date of Patent: Oct. 14, 1986

[54] ELECTRICAL CONNECTOR APPARATUS, AND METHODS AND APPARATUS FOR ASSEMBLING SAME

[75] Inventors: Ray C. Doutrich, Lebanon; George T. DeShong, East Berlin, both of Pa.

[73] Assignee: E. I. Du Pont de Nemours and Company, Wilmington, Del.

[21] Appl. No.: 729,162

[22] Filed: Apr. 30, 1985

[51] Int. Cl.[4] ..... H01R 43/00

[52] U.S. Cl. ..... 29/857; 339/276 T

[58] Field of Search ..... 29/749, 857–859, 29/861–863, 33 M, 564.4, 564.6; 339/223 R, 217 S, 276 R, 276 T, 276 SF

[56] References Cited

U.S. PATENT DOCUMENTS

| | | | |
|---|---|---|---|
| 3,370,265 | 2/1968 | Berg | 339/256 |
| 3,781,760 | 12/1973 | Mancini et al. | 339/59 M |
| 4,214,361 | 7/1980 | Coldren et al. | 29/863 |
| 4,411,484 | 10/1983 | Casey | 339/276 T X |

*Primary Examiner*—Eugene F. Desmond

[57] ABSTRACT

A partially pre-assembled electrical connector has metal terminals partially inserted in a housing. The connectors are completed by at least partially withdrawing each terminal from the housing, placing the end of a wire in the exposed portion of the terminal, crimping the terminal on the wire, and then fully inserting the terminal in the housing.

16 Claims, 27 Drawing Figures

ACT.
282
280
180a
114
240

180a
270
272
230b
230a
14
7c
110c
110b
110a
150
220
200

230a
110a
224
266
260
262
264
250
222

ELECTRICAL CONNECTOR APPARATUS, AND METHODS AND APPARATUS FOR ASSEMBLING SAME

BACKGROUND OF THE INVENTION

This invention relates to electrical connectors of the type in which multiple electrical conductors are respectively connected to multiple terminals enclosed within a housing. The invention also relates to methods and apparatus for making such electrical connectors.

Manufacturers of electrical connectors for use in electronic circuitry such as computers typically provide their customers (e.g., computer manufacturers) with separate connector components such as terminals and terminal housings. The customer electrically and mechanically connects each terminal to an electrical conductor (e.g., a wire) and inserts the terminal in a terminal housing. This can be a costly and troublesome process for the customer because of the difficulties associated with handling the relatively small terminals and especially inserting the terminals in the terminal housing.

In view of the foregoing, it is an object of this invention to provide improved methods and apparatus for assembling electrical connector terminals in terminal housings.

It is another object of this invention to provide electrical connectors which are partially pre-assembled in order to facilitate final assembly of the connectors.

SUMMARY OF THE INVENTION

These and other objects of the invention are accomplished in accordance with the principles of the invention by providing electrical connectors in which the terminals are partially pre-inserted and releasably retained in a terminal housing. When the electrical conductors (wires) are to be connected to the terminals, each terminal is partially ejected from the housing so that the appropriate conductor can be placed in the terminal. The terminal is then crimped around the conductor and pushed all the way back into the housing where it is latched in place. Apparatus is provided for partially ejecting the pre-inserted terminals from the housing, crimping the partially ejected terminals around conductors placed in the terminals, and then fully reinserting the crimped terminals in the housing.

Further features of the invention, its nature and various advantages will be more apparent from the accompanying drawings and the following detailed description of the invention.

BRIEF DESCRIPTION OF THE DRAWINGS

FIG. 3*a* shows the apparatus at a first stage in its operating cycle.

FIG. 3*a* shows only the portion of the apparatus above the line A—A in FIG. 3*b*. FIGS. 3*a* and 3*b* are sometimes referred to collectively as FIG. 3.

FIGS. 4–12 (each including an "a" view similar to FIG. 3*a* and a "b" view similar to FIG. 3*b*) show successive stages in the operating cycle of the apparatus of FIG. 3. FIGS. 4–12 are somewhat simplified as compared to FIG. 3. For example, the track on which the connector rests is not repeated in FIGS. 4–12, and the details on the top surface of the connector are also not repeated in FIGS. 4–12.

DETAILED DESCRIPTION OF THE INVENTION

Figure 1:
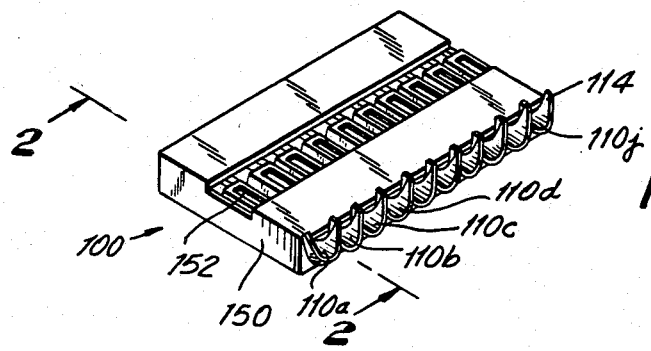
FIG. 1 is a perspective view of an illustrative embodiment of a partially pre-assembled electrical connector constructed in accordance with the principles of the invention.

This invention has particular application to electrical connectors of the type shown in Mancini et al. U.S. Pat. No. 3,781,760. As shown in that patent, a female terminal 34, 40, 42 is disposed in connector block 10 so that flexible latch 32 is behind disconnect portion 34 of the terminal. The uninsulated end of conductor 38 is engaged by wire crimp portion 40 of the terminal. The end of the insulation on conductor 38 is similarly engaged by insulation crimp portion 42 of the terminal. Disconnect portion 34 has a transverse cross section which is generally the shape of a hollow rectangle. A spring, which bows downwardly, is provided in the upper part of the hollow rectangle. Disconnect portion 34 is adapted to receive a male connector (not shown) which is a square metal pin. When a pin is in disconnect portion 34, the spring is deflected upwardly by the pin. This assures good electrical contact and good mechanical engagement between the male and female connector elements. Any number of such terminals can be arranged side by side in connector block 10.

Heretofore, connector blocks 10 and terminals 34-40-42 have been sold separately by the manufacturers of such apparatus. The purchaser has had to apply the terminals to the ends of the wires terminating at the connector, and has then had to insert the terminals in the connector block.

Figure 2:
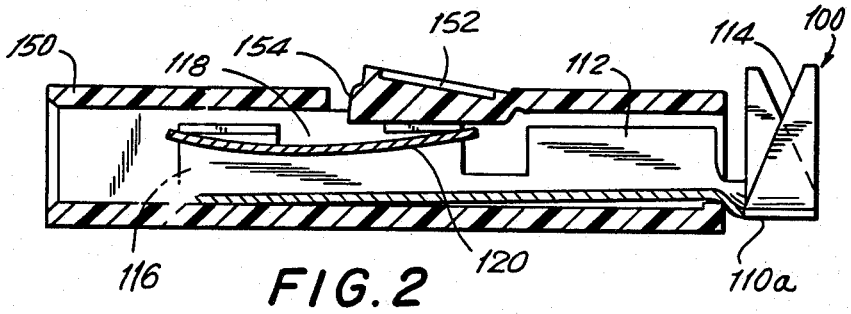
FIG. 2 is a cross-sectional view taken along the line 2—2 in FIG. 1.

In accordance with this invention, terminals 110 (similar to terminals 34-40-42 in the above-mentioned Mancini et al. patent, but with wire crimp portion 112 and insulation crimp portion 114 uncrimped) are partially pre-inserted in terminal housing 150 (similar to Mancini et al.'s connector block 10) to produce a partially pre-assembled connector 100 having the configuration shown in FIGS. 1 and 2. Each terminal 110 is preferably inserted far enough into terminal housing 150 so that the associated latch 152 (similar to Mancini et al.'s latches 32) lightly and releasably engages the terminal. In the depicted embodiment, terminals 110 are inserted until uncrimped insulation crimp portions 114 contact the rear of terminal housing 150 and thereby prevent further insertion of each terminal. In this position, the free end or nose portion 154 of each latch 152 bears on the top of the disconnect portion 116 of associated terminal 110 (similar to Mancini et al.'s disconnect portion 34). In particular, each nose portion 154 preferably enters the gap 118 above the center of spring 120 in associated terminal 110 to a slight degree, which is not sufficient to permanently latch the terminal in housing 150, but which does increase the terminal's resistance to inadvertent withdrawal from the housing.

Figure 6A:
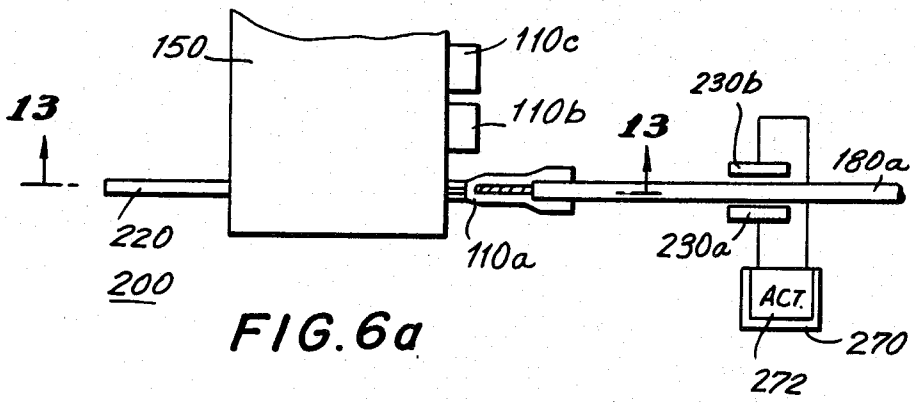
Figure 6C:
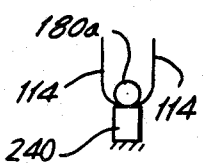
FIGS. 6*c* and 7*c* are partial elevational views taken along the lines 6*c*—6*c* and 7*c*—7*c* in FIGS. 6*b* and 7*b*, respectively. Associated "a", "b", and "c" views are sometimes referred to collectively by the Figure number alone (e.g., "FIG. 4" refers to FIGS. 4*a* and 4*b* collectively).
Figure 6B:
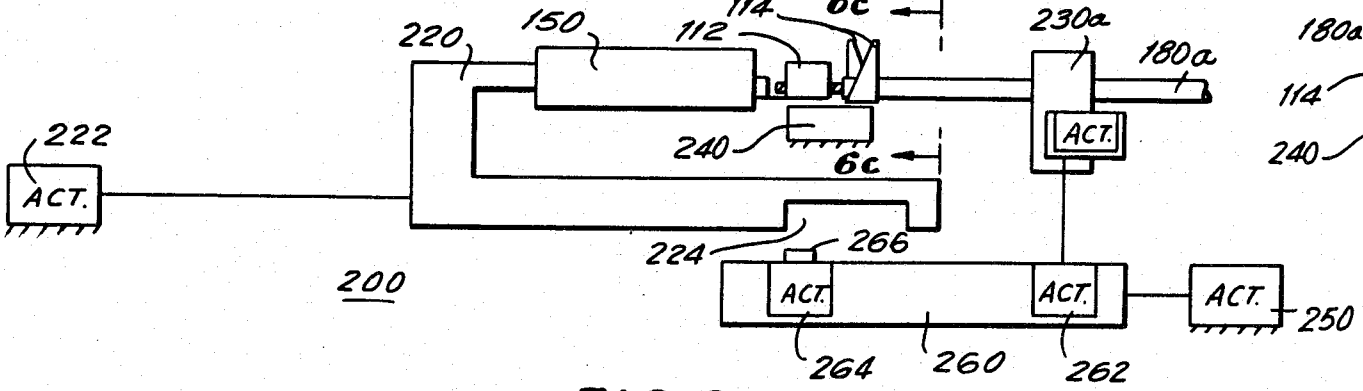
Figure 13:
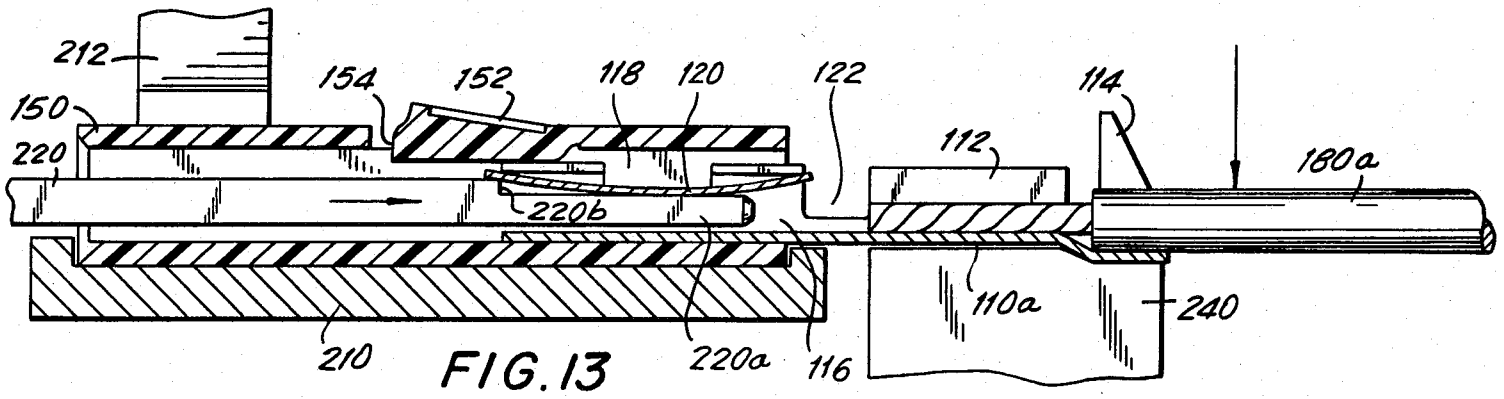
FIG. 13 is a cross sectional view taken along the line 13—13 in FIG. 6*a*.

Further in accordance with this invention, users of the above-described partially pre-assembled connectors 100 can employ the following method to complete the assembly of the connector: Each terminal 110 is partially withdrawn from the rear of housing 150, as shown, for example, in FIG. 4, to expose at least wire crimp portion 112 (in addition to insulation crimp portion 114). The end of the wire 180 to be connected to the terminal is placed in the terminal so that an uninsulated end portion of the wire is adjacent wire crimp portion 112, and so that the end portion of the insulation is adjacent insulation crimp portion 114 as shown in FIGS. 6 and 13. Wire crimp portion 112 is then crimped on the uninsulated end portion of the wire, and insulation crimp portion 114 is crimped on the end of the insulation as shown, for example, in FIGS. 7 and 14. The terminal is then fully inserted into terminal housing 150 so that the associated latch 152 drops into the notch 122 behind disconnect portion 116, as shown, for example, in FIG. 15, to permanently secure the terminal in housing 150 in the manner taught by Mancini et al.

Figure 3A:
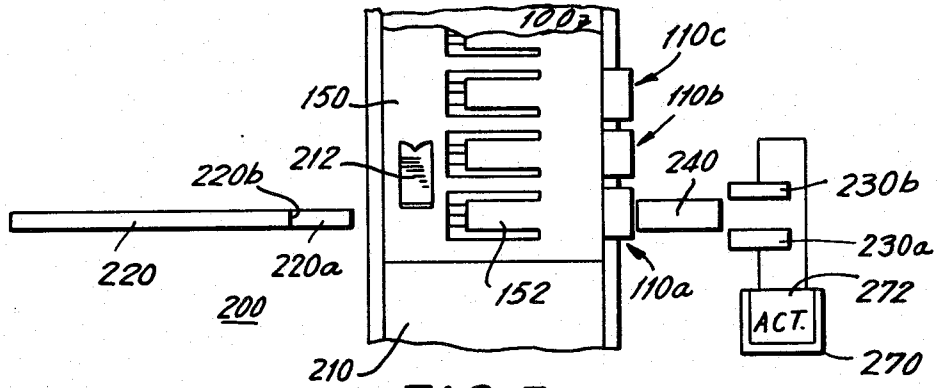
FIG. 3*a* is a schematic partial plan view of illustrative apparatus for completing assembly of the connector of FIGS. 1 and 2 in accordance with the invention.
Figure 3B:
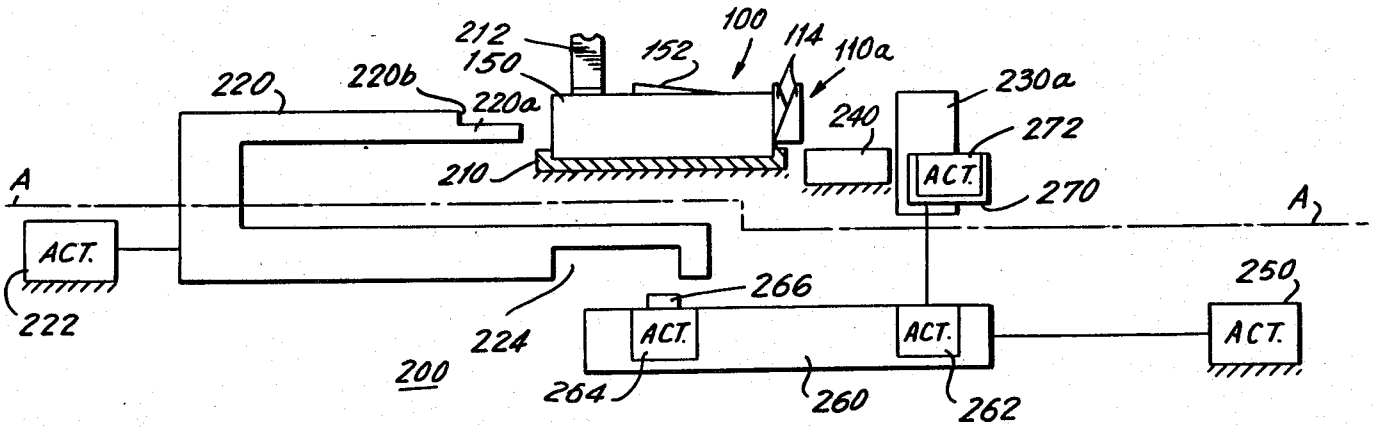
FIG. 3*b* is a schematic partial elevational view of the apparatus of FIG. 3*a*.

Illustrative apparatus 200 (constructed in accordance with this invention) for carrying out the foregoing method is shown in FIGS. 3–15. With apparatus 200 in the initial condition as shown in FIG. 3, partially assembled connector 100 is placed on stationary track 210 with the first of terminals 110 (i.e., terminal 110*a*) coaxial with push-out mandrel 220. Connector 100 is held on track 210 by one or more resilient hold-down fingers 212.

Figure 4A:
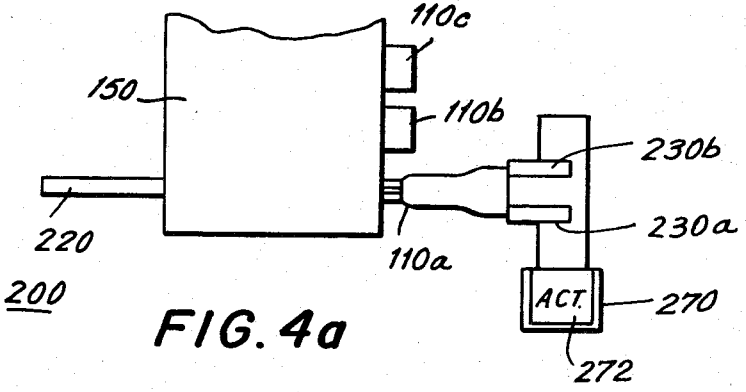
Figure 4B:
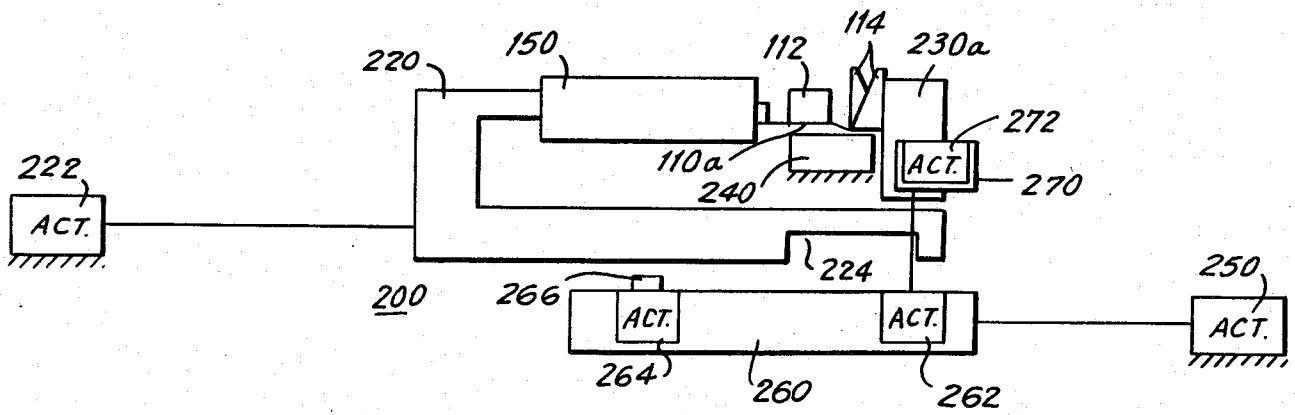

Actuator 222, which may be a conventional double-acting hydraulic or pneumatic linear actuator or an equivalent device, is then operated as shown in FIG. 4 to drive push-out mandrel 220 part way into housing 150. The leading portion 220*a* of push-out mandrel 220 enters the disconnect portion 116 of terminal 110*a* (see FIG. 13). Thereafter the shoulder 220*b* behind leading portion 220*a* contacts the front face of terminal 110*a* and pushes the terminal part way out of housing 150 (refer again to FIG. 4). The rear surface of terminal 110*a* contacts wire grippers 230*a* and 230*b*. Wire grippers 230 therefore act as a stop for terminal 110*a* and ensure that leading portion 220*a* is fully inserted in disconnect portion 116. When terminal 110*a* is thus partially ejected from housing 150, wire crimp portion 112 and insulation portion 114 are both exposed and positioned over stationary anvil 240. Terminal 110*a* is held in this position by the snug fit of leading portion 220*a* in disconnect portion 116.

Figure 5A:
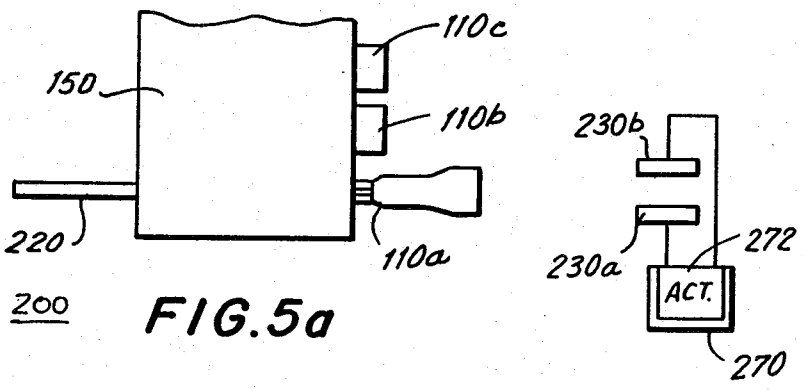
Figure 5B:
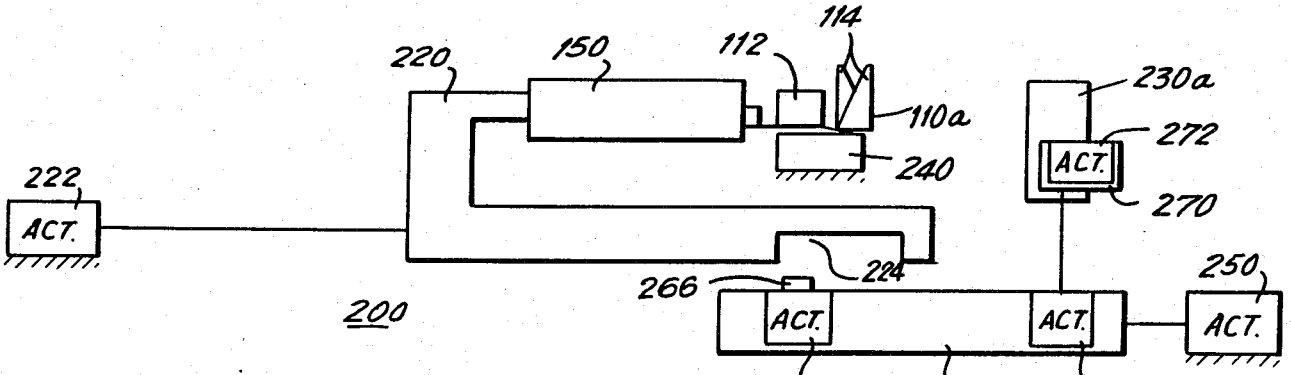

The next step in the operation of the apparatus is movement of wire grippers 230 away from terminal 110*a* along an axis parallel to the longitudinal axis of the terminal (see FIG. 5). This is accomplished by operation of actuator 250, which may be a conventional device similar to actuator 222. Actuator 250 reciprocates actuator carrier 260, on which are mounted actuators 262 and 264. Actuator 262, which may be another conventional device similar to actuator 222, can vertically reciprocate actuator carrier 270 as described in detail below. Actuator 272, which may be another conventional device similar to actuator 222, is mounted on carrier 270. Actuator 272 can reciprocate wire grippers 230*a* and 230*b* toward or away from one another as described in detail below. Accordingly, wire grippers move horizontally with actuator carrier 260 in response to operation of actuator 250, The next step in the operation of the apparatus is placement of wire 180*a* in terminal 110*a* as shown in FIGS. 6 and 13. It should be noted that a portion of wire 180*a* is between wire grippers 230*a* and 230*b*.

Figures 7A, 7B, 7C:
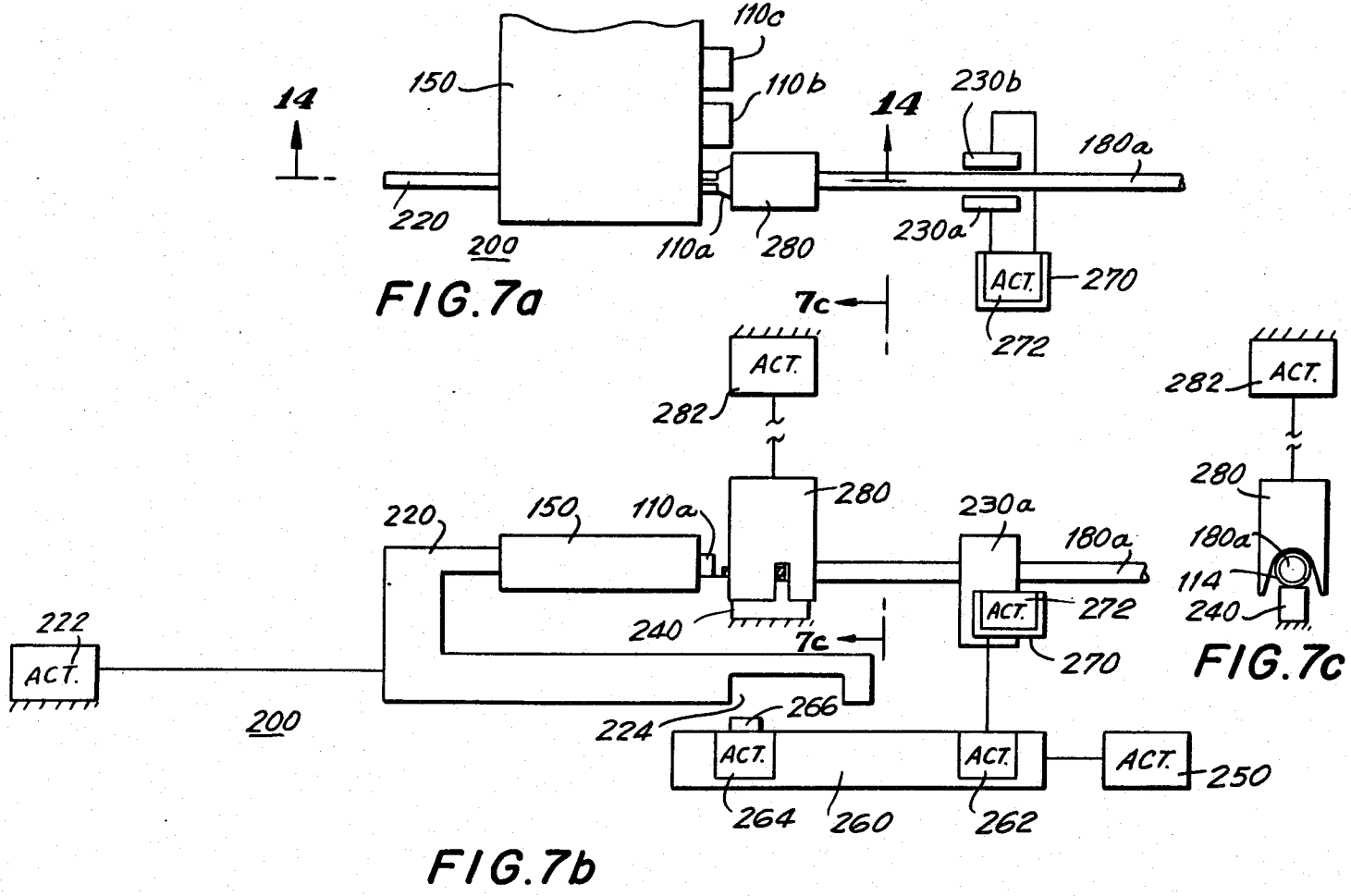
Figure 8A:
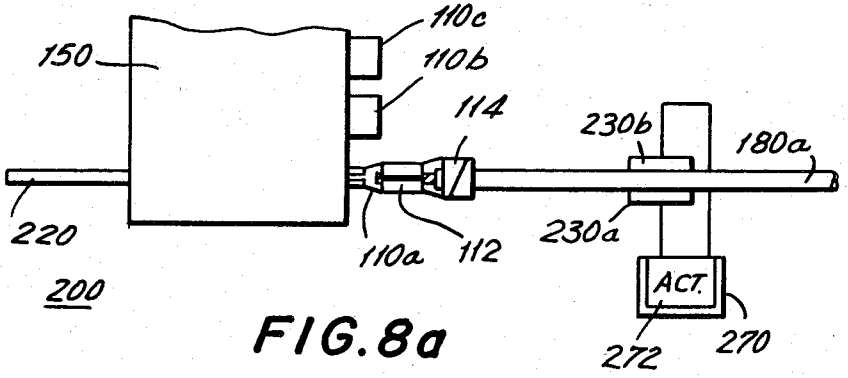
Figure 8B:
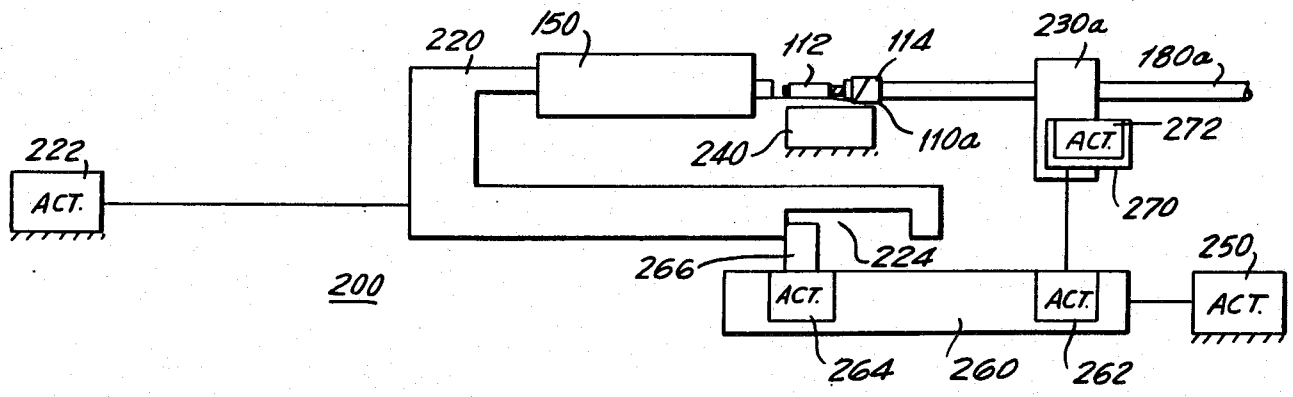
Figure 14:
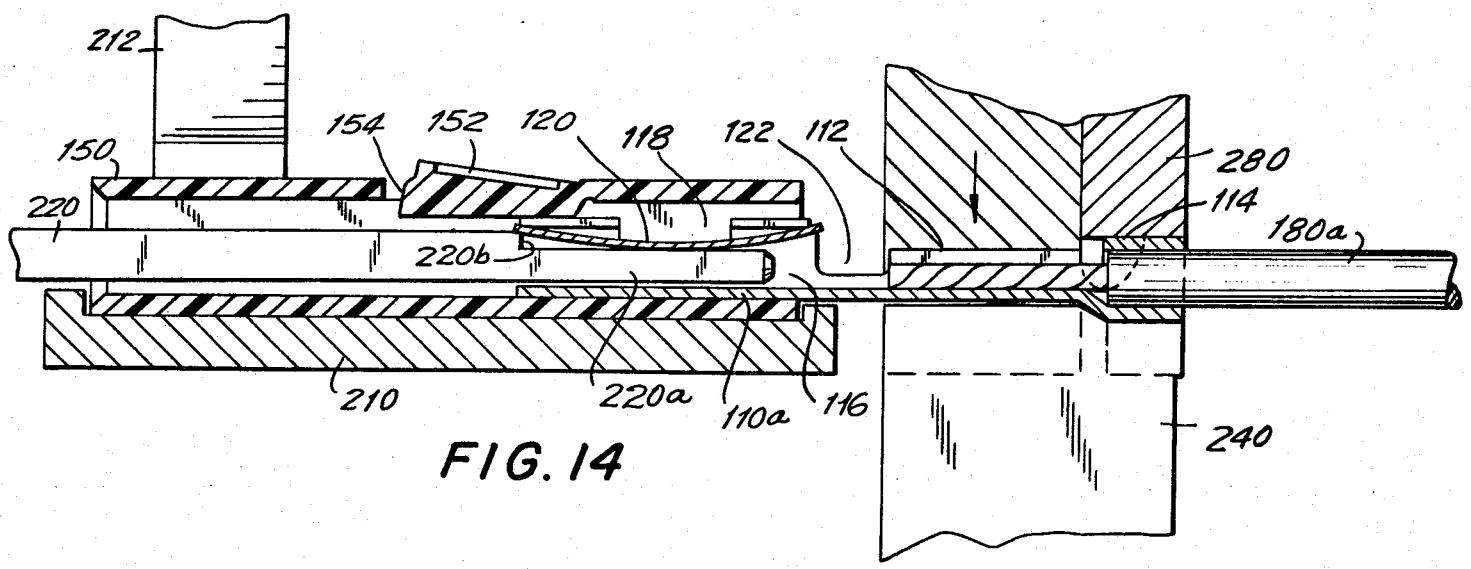
FIG. 14 is a cross sectional view taken along the line 14—14 in FIG. 7*a*.

After wire 180*a* is in place as described above, crimper 280 is lowered by operation of actuator 282, which can be another conventional device similar to actuator 222 (see FIGS. 7 and 14). Crimper 280 cooperates with anvil 240 to crimp wire crimp portion 112 on the uninsulated end portion of wire 180*a* and to crimp insulation crimp portion 114 on the end of the insulation of wire 180*a*.

After terminal 110*a* has thus been mechanically and electrically connected to wire 180*a*, the following operations take place: (1) actuator 282 is operated again to raise crimper 280; (2) actuator 272 is operated to move wire grippers 230*a* and 230*b* toward one another so that wire 180*a* is gripped between grippers 230; and (3) actuator 264 is operated to raise latch 266 into recess 224 in mandrel 220 (see FIG. 8).

Figure 9A:
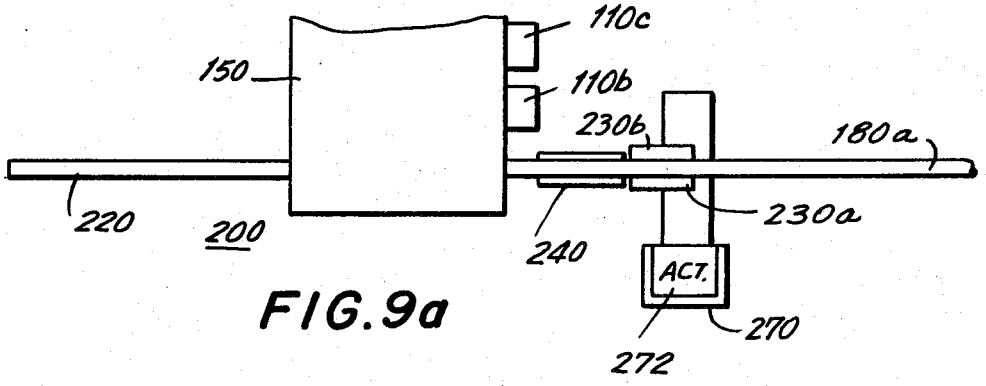
Figure 9B:
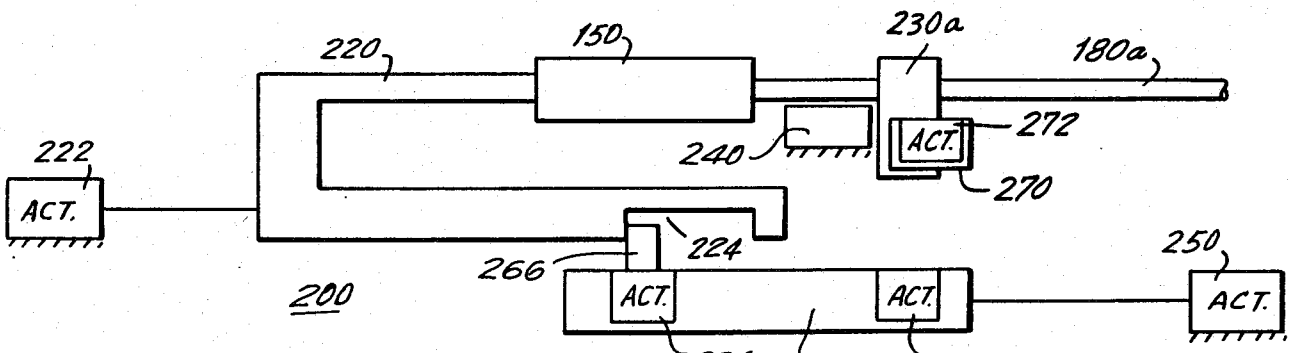

Following the above-described operations, actuator 250 is operated again to move actuator carrier 260 horizontally toward housing 150 (see FIG. 9). Wire grippers 230, with wire 180*a* gripped between them, move with actuator carrier 260 toward housing 150. Accordingly, wire grippers 230, acting through wire 180*a*, push terminal 110*a* fully into housing 150. Mandrel 220 travels with wire grippers 230 by virture of the presence of latch 266 in recess 224. Actuator 222 idles during this motion of mandrel 220. Accordingly, mandrel 220 is retracted relative to housing 150 at the same time as and at the same rate that wire grippers 230 are pushing terminal 110*a* into housing 150.

Figure 15:
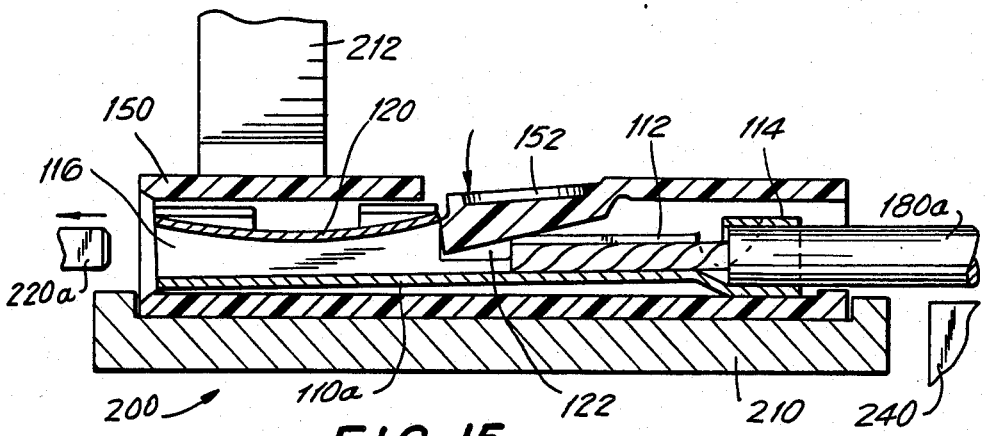
FIG. 15 is a cross sectional view taken along the line 15—15 in FIG. 10*a*.
Figure 10A:
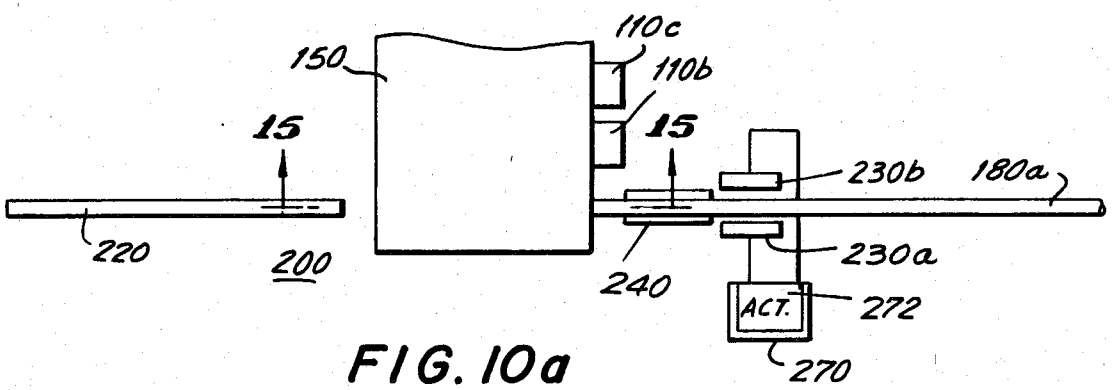
Figure 10B:
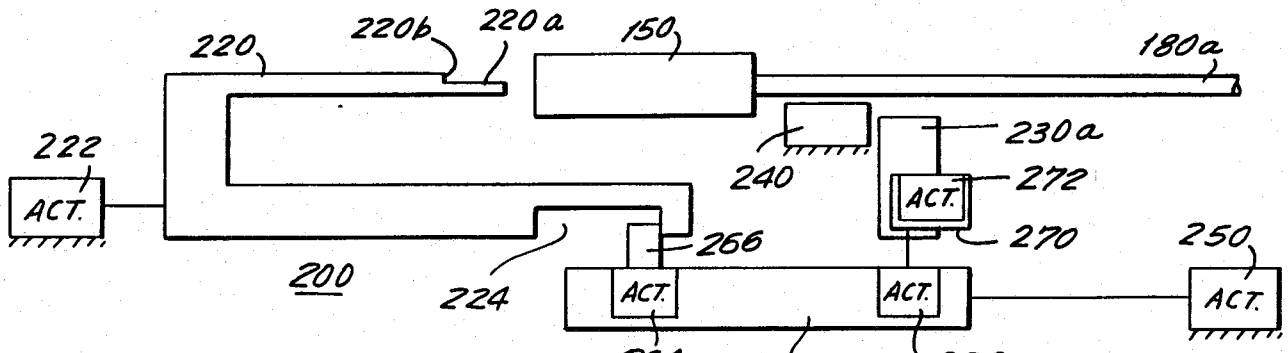
Figure 11A:
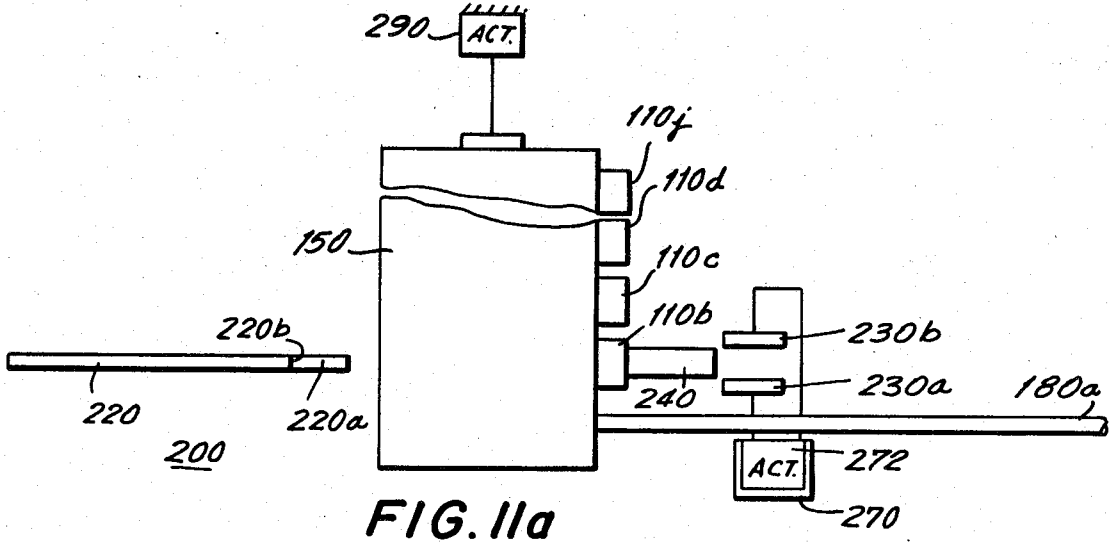
Figure 11B:
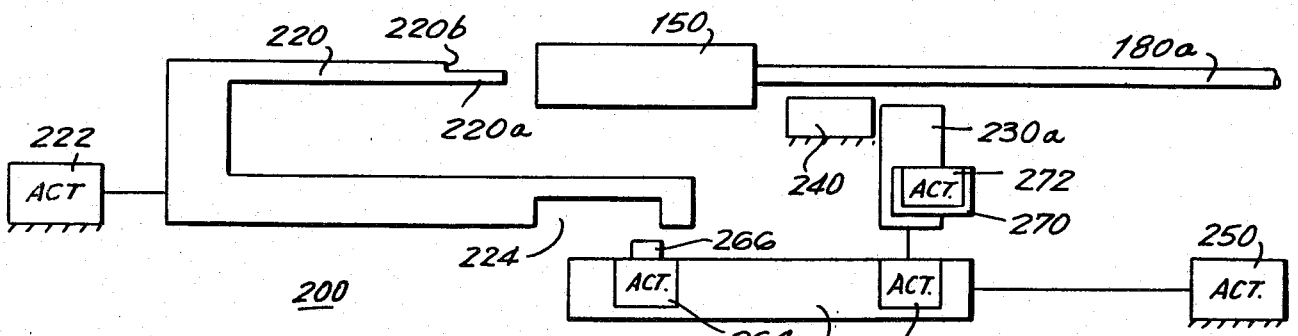

After terminal 110*a* has been fully pushed into housing 150 as described above, actuator 222 is operated again to fully withdraw mandrel 220 from housing 150 (see FIGS. 10 and 15). In addition, actuator 262 is operated to lower wire grippers 230 below the horizontal plane in which wire 180*a* lies.

The processing of terminal 110*a* and wire 180*a* is now complete and the apparatus is ready to begin processing of the next terminal 110*b*. Accordingly, actuator 290, which may be similar to actuator 222, is operated to push housing 150 along track 210 until terminal 110*b* is coaxial with mandrel 220 (see FIG. 11). Actuator 264 is also operated again to lower latch 266 so that the latch no longer extends into recess 224.

Figure 12A:
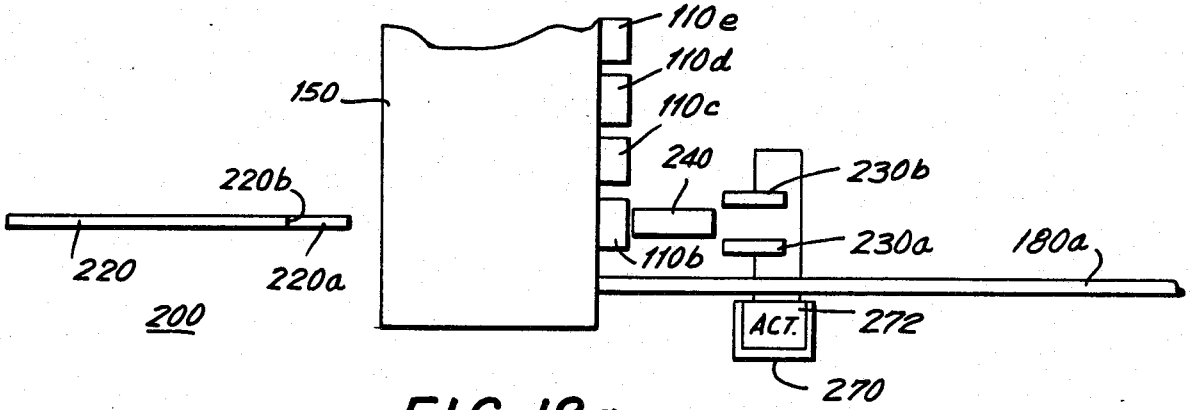
Figure 12B:
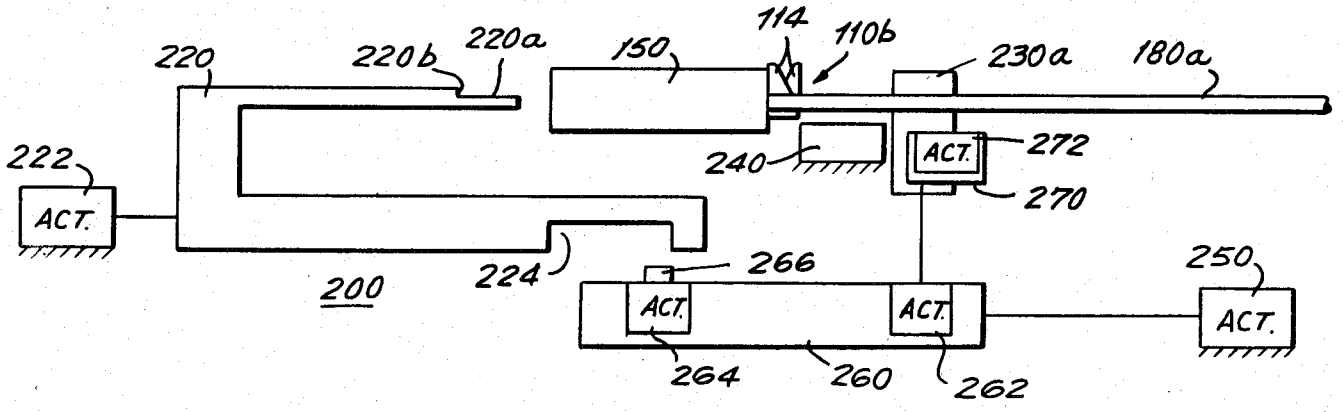

When the foregoing operations have been performed, actuator 262 is operated again to raise wire grippers 230 so that they intersect the horizontal plane in which wire 180*a* lies (see FIG. 12). It will be noted that the condition of the apparatus in FIG. 12 is the same as the condition of the apparatus in FIG. 3 except that terminal 110*a* has been completed in FIG. 12 and housing 150 has been shifted one terminal spacing along track 210. Accordingly, the above-described operating cycle of the apparatus begins again and is repeated until all of terminals 110 have been wired and fully inserted in housing 150. Thereafter, the fully assembled connector can be removed from the apparatus and is ready for use.

Although the invention has been described in the context of connectors having female terminals 110, it will be understood that the invention is equally applicable to connectors having male terminals. In that event, the leading portion of push-out mandrel 220 would be modified to include a socket for receiving a male terminal pin. In other respects the method and apparatus of this invention would be as described above.

We claim:

1. The method of fabricating an electrical connector comprising the steps of:

providing a partially pre-assembled connector including a housing having a plurality of longitudinal, laterally adjacent, substantially parallel apertures, each aperture extending all the way through the housing between front and rear housing surfaces, and a longitudinal metal terminal partially inserted in each aperture substantially parallel to the longitudinal axis of the associated aperture, each terminal having a front disconnect portion and an uncrimped rear wire crimp portion, the disconnect portion being disposed in the aperture and a least a portion of the wire crimp portion being outside the housing to the rear of the rear surface;

at least partially withdrawing each terminal from the associated aperture to completely expose the uncrimped wire crimp portion;

placing a wire in the exposed uncrimped wire crimp portion of each terminal;

crimping the exposed wire crimp portion of each terminal around the associated wire to secure the wire to the terminal; and fully re-inserting the terminal in the associated aperture.

2. The method defined in claim 1 wherein each terminal is at least partially withdrawn from the housing in the rearward direction.

3. The method defined in claim 1 wherein a portion of each terminal remains in the associated aperture at all times during performance of the method.

4. The method defined in claim 1 further comprising the step of latching each fully re-inserted terminal in the housing.

5. The method defined in claim 1 wherein each terminal has a female disconnect portion and wherein the step of least partially withdrawing each terminal comprises the steps of:

inserting a pin in the disconnect portion of each terminal to stabilize the terminal during the subsequent wire placement and terminal crimping steps; and pushing on the front edge of the disconnect portion of each terminal to at least partially push the terminal from the associated aperture in the rearward direction.

6. The method defined in claim 5 wherein the pin is inserted in the disconnect portion of each terminal via the front portion of the associated aperture.

7. The method defined in claim 1 wherein the fully re-inserting step comprises the steps of:

gripping each wire to the rear of the associated crimped wire crimp portion; and pushing the gripped wire toward the housing.

8. The method defined in claim 6 wherein the fully re-inserting step comprises the steps of:

gripping each wire to the rear of the associated crimped wire crimp portion; and pushing the gripped wire toward the housing.

9. The method defined in claim 8 further comprising the step of withdrawing the pin from each fully re-inserted terminal.

10. The method defined in claim 1 wherein the terminals are processed one at a time in succession in accordance with the foregoing steps, and wherein the method further comprises the step of moving the connector after each terminal is processed to position the connector for processing of the next terminal.

11. Apparatus for fabricating an electrical connector from a partially pre-assembled device including a housing having a plurality of longitudinal, laterally adjacent, substantially parallel apertures, each aperture extending all the way through the housing between front and rear housing surfaces, and a longitudinal metal terminal partially inserted in each aperture substantially parallel to the longitudinal axis of the associated aperture, each terminal having a front disconnect portion and an uncrimped rear wire crimp portion, the disconnect portion being disposed in the aperture and at least a portion of the wire crimp portion being outside the housing to the rear of the rear surface, comprising:

means for at least partially withdrawing each terminal from the associated aperture to completely expose the uncrimped wire crimp portion;

means for crimping the exposed wire crimp portion of each terminal around an associated wire placed in the wire crimp portion; and means for fully re-inserting the terminal in the associated aperture.

12. The apparatus defined in claim 11 wherein each terminal has a female disconnect portion and wherein the means for at least partially withdrawing each terminal comprises:

a pin having an initial end portion which is removably receivable in the disconnect portion of each terminal and a remaining portion which is larger in cross section than the disconnect portion but smaller in cross section than the front portion of the associated aperture; and means for reciprocating the pin into the aperture so that the initial end portion enters the disconnect portion and so that the remaining portion pushes the terminal from the aperture in the rearward direction.

13. The apparatus defined in claim 12 wherein the initial end portion of the pin fits sufficiently securely in the disconnect portion of the terminal to releasably retain the terminal on the pin and to substantially prevent rotation of the terminal about the longitudinal axis of the pin.

14. The apparatus defined in claim 11 wherein the means for crimping comprises:

anvil means disposed adjacent one side of the exposed wire crimp portion; and crimp means for crushing the exposed wire crimp portion against the anvil means.

15. The apparatus defined in claim 11 wherein the means for fully re-inserting comprises:

means for gripping the wire to the rear of the associated wire crimp portion and pushing the wire toward the housing.

16. The apparatus defined in claim 11 wherein the terminals are processed one at a time in succession and wherein the apparatus further comprises:

means for moving the housing after each terminal has been processed to position the housing for processing of the next terminal.

* * * * *